US012018483B2

(12) United States Patent
Knoblauch et al.

(10) Patent No.: US 12,018,483 B2
(45) Date of Patent: Jun. 25, 2024

(54) ACOUSTIC BAFFLE TO BE ARRANGED IN A BUILDING

(71) Applicant: Knauf Gips KG, Iphofen (DE)

(72) Inventors: Karl Michael Knoblauch, Werbach (DE); Markus Riessler, Wolpertshausen (DE); Michael Viebahn, Iphofen (DE)

(73) Assignee: Knauf Gips KG, Iphofen (DE)

( * ) Notice: Subject to any disclaimer, the term of this patent is extended or adjusted under 35 U.S.C. 154(b) by 1203 days.

(21) Appl. No.: 16/312,920

(22) PCT Filed: Jun. 24, 2016

(86) PCT No.: PCT/EP2016/001080
§ 371 (c)(1),
(2) Date: Dec. 21, 2018

(87) PCT Pub. No.: WO2017/220103
PCT Pub. Date: Dec. 28, 2017

(65) Prior Publication Data

US 2019/0186132 A1 Jun. 20, 2019

(51) Int. Cl.

| | |
|---|---|
| ***E04B 9/28*** | (2006.01) |
| ***E04B 1/84*** | (2006.01) |
| ***E04B 9/00*** | (2006.01) |
| ***E04B 9/36*** | (2006.01) |
| *E04B 9/06* | (2006.01) |

(52) U.S. Cl.
CPC ..... *E04B 9/001* (2013.01); *E04B 1/8404* (2013.01); *E04B 9/28* (2013.01); *E04B 9/363* (2013.01); *E04B 9/366* (2013.01); *E04B 1/84* (2013.01); *E04B 9/067* (2013.01)

(58) Field of Classification Search
CPC ..... E04B 1/8404; E04B 1/84; E04B 9/001; E04B 9/28; E04B 9/363; E04B 9/366; E04B 9/067; E04B 9/36
See application file for complete search history.

(56) References Cited

U.S. PATENT DOCUMENTS

| | | | | |
|---|---|---|---|---|
| 2,160,638 | A * | 5/1939 | Bedell | E04B 9/34 181/295 |
| 2,659,808 | A * | 11/1953 | Beckwith | E04B 9/34 362/149 |
| 2,730,942 | A * | 1/1956 | Peterson | F24F 13/24 165/110 |
| 4,197,923 | A * | 4/1980 | Harris | E04B 9/34 181/291 |
| 4,200,171 | A | 4/1980 | Seymour et al. | |
| 2012/0291397 | A1 | 11/2012 | Bergman | |
| 2013/0047541 | A1 * | 2/2013 | Mayer | E04B 9/366 52/506.05 |

(Continued)

FOREIGN PATENT DOCUMENTS

| | | | | |
|---|---|---|---|---|
| WO | WO-0063507 | A1 * | 10/2000 | E04B 9/16 |

*Primary Examiner* — Jessie T Fonseca
(74) *Attorney, Agent, or Firm* — Mark Terry

(57) ABSTRACT

An acoustic baffle (1) to be arranged in a building for the absorption of sound propagating there through, the acoustic baffle (1) comprising at least one panel (2) of a sound absorbing material, wherein the baffle (1) comprises at least one edge portion (3) having a recess (4) arranged therein of a size and shape so as to be capable of accommodating a suspension profile (8) in form-fit therein.

9 Claims, 3 Drawing Sheets

(56) References Cited

U.S. PATENT DOCUMENTS

Figure 1:
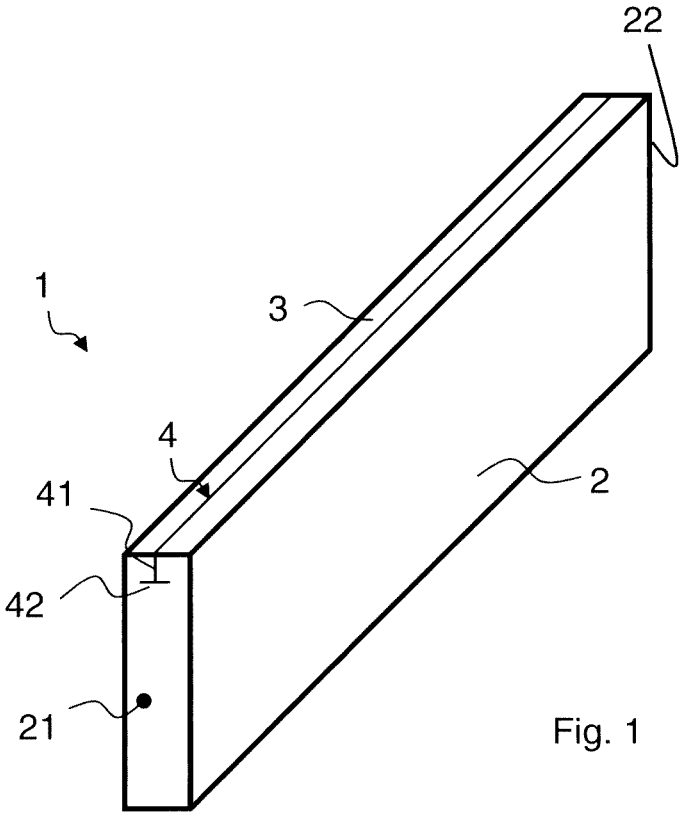

| | | | | |
|---|---|---|---|---|
| 2014/0157689 | A1* | 6/2014 | Bergman | E04B 9/10<br>52/745.13 |
| 2017/0268228 | A1* | 9/2017 | Bergman | E04B 9/04 |

* cited by examiner

ACOUSTIC BAFFLE TO BE ARRANGED IN A BUILDING

The invention relates to an acoustic baffle to be arranged in a building for the absorption of sound propagating there through.

The present invention is from the technical field of room acoustics. Room acoustics deals in general with propagating sound waves in the enclosed space of a room (i.e. in a building). The sound behavior can inter alia be described to behave similar to rays of light propagating through the room. The sound waves are reflected at the walls, the floor and the ceiling of the room. The incident waves interfere with the reflected waves whereby the corresponding amplitudes add to respective sound maxima as well as sound minima (e.g. as standing wave).

Especially in case of supplementary acoustic optimization or as an alternative or additionally to a (acoustically effective) suspended ceiling, sound absorption by use of acoustic baffles offers a possibility to absorb sound and substantially improve the room acoustics. Conventionally, a plurality of acoustic baffles is arranged at the ceiling. Incident sound waves are absorbed therefrom what minimize the sound reflected from the ceiling downwardly.

A product well known in the market is the KNAUF AMF THERMATEX BAFFLE which is a fleece coated panel made of a sound absorbing material. The panel has a rectangular cross sectional shape (e.g. 1200×300 mm) and is enclosed by a metal frame. The baffles are fixed to the ceiling in a conventional manner via suspension wires which are fixed to the ceiling by use of a cable hanger and fixed to a connector tab at the baffle frame. The baffle frame is a closed metal profile of the width of the panel which circumferentially encloses the panel. The tab connector at the baffle frame can for example be formed as side tab connector or top screw. A disadvantage related to this installation is the presence of the metal frame which prevents a continuous design extending from one side surface of the baffle to the opposite side surface.

In the prior art of sound absorption systems it is known to provide acoustic baffles without a metal frame. For example in GB 2 182 481 A for the absorption of noise, a panel of porous sound absorbing material is known which is enclosed in a thin sound permeable covering. The covering allows the transmission of sound propagating through the covering onto the sound absorbing material.

A seam is formed by the covering which delimits the chamber for arranging the sound absorbing material therein. The seam allows connecting a suspension wire at the covering for installation of the baffle at the ceiling. In principle this baffle allows to apply a continuous design extending from one side surface of the baffle to the opposite side surface because of the seam and the suspension wire for suspending the baffle can be arranged at the side surface or at the top surface of the baffle.

However, the disadvantage related thereto is that the suspension wire is connected to the covering which is mechanically not very strong. This problem is particularly important since the covering material is chosen as thin as possible to allow for a good sound permeability.

The object of the invention is therefore to provide an acoustic baffle which allows a mechanically strong installation at the ceiling of a room, while the acoustic baffle allows for a continuous design from one side surface thereof to the other.

The problem is solved by an acoustic baffle and method for producing an acoustic baffle with the features of the respective independent claim. Advantageous aspects are explained by their features in the dependent claims.

The invention comprises an acoustic baffle to be arranged in a building for the absorption of sound propagating there through. The acoustic baffle comprises at least one panel of a sound absorbing material. The acoustic baffle further comprises at least one edge portion having a recess arranged therein of a size and shape so as to be capable of accommodating a suspension profile in form-fit therein. The recess allows for attaching the suspension profile in a mechanically very strong connection and allows for an easy installation of the baffle to the ceiling in the room. The recess can be shaped in many ways, wherein it is of advantage, if it provides a projection behind which the suspension profile can engage. The recess can be formed in the panel. The form-fit explicitly includes the use of friction forces for fastening the profile to the baffle. The form-fit further includes the use of adhesive materials for improving the connection.

Preferably, the baffle is frameless. The connection of the baffle to the ceiling described herein by use of a suspension profile arranged in a recess overcomes the need of a (metal) frame enclosing the acoustic baffle (i.e. the panel) for the connection of a suspension wire. Since no frame is needed for the installation, a continuous design extending from one side of the panel to the other side can be arranged thereon.

Preferably, the recess extends continuously along the at least one edge portion between a first side surface and a second side surface. The at least one edge portion comprises in the mounted state the upper side surface, wherein the recess is formed as slit in the upper surface and extends over the length of the panel.

According to an advantageous aspect, the recess has a first section extending rectangular to the (outer) surface of the (outer surface of the) edge portion and a second section joined to the first section extending parallel to the surface of the edge portion so as to form a recess capable of accommodating a T-shaped suspension profile therein. By providing a recess having a T-shaped cross section, the recess (comprises) forms a projecting portion behind which the suspension profile can engage in a form-fit.

According to another preferred aspect, the baffle comprises a first panel portion and a second panel portion which are connected to each other so that one side surface of the first panel portion contacts one side surface of the second panel portion forming the recess at the interface between the first panel portion and the second panel portion. This allows for making the baffle from a single folded panel or from a first panel portion which is separate from a second panel portion.

Preferably, the first panel portion and the second panel portion are folded parts of one single panel. The folded panel can be designed before it is folded so that the design is applied over entire surface on one side and extends in the folded state continuously and seamlessly from one side of the panel to the other side. This design aspect is particularly of advantage in combination with the frameless embodiment.

According to another advantageous aspect, the first panel portion comprises a first slit and the second panel portion comprises a second slit. The first slit and the second slit are (arranged in the folded state) aligned so as to form the second section of the recess. This allows forming a T-shaped cross section, wherein the recess includes a projecting portion behind which the suspension profile can form-fittingly engage.

According to yet another aspect, the panel comprises a third panel portion arranged between the first panel portion and the second panel portion. Separate V-shaped cut out sections are formed (so as to be arranged) between the first panel portion and the third panel portion and between the second panel portion and the third panel portion, respectively. The V-shaped cut out sections allow for folding the respective panel portions to each other and provide a stop at a preferred respective angle of 90°. The width of the third panel portion is chosen such that in the folded state, the first panel portion preferably flatly contacts the second panel portion.

Preferably, the baffle has an illustration or décor (design), continuously and seamlessly extending at least from a front side over a bottom side to a back side of the baffle. The extension from the front side over a bottom side to a back side of the baffle can be achieved by applying the design to one surface of the panel and folding the first panel portion, the second panel portion and the third panel portion, respectively.

The design can preferably be applied by digitally printing the surface of the panel. Especially preferred the ink used for printing is water based. Using a water based ink has the advantage that it is poor in VOCs (volatile organic compounds). Further, the water based ink does not impair the open porous structure of the baffle material and thus, is acoustically neutral.

One particularly preferred aspect relates to that a suspension profile is arranged in the recess. The suspension profile can be arranged at the production site of the baffle or at the construction site when the baffle is installed.

Another aspect of the invention relates to a method for producing an acoustic baffle. This method comprises the steps of:

providing a panel of a sound absorbing material;

(optionally) applying an illustration or a décor on at least one of the main surfaces of the panel, preferably by digital printing; and providing at least one slit in another (not the main) surface of the panel to form a recess capable of accommodating a suspension profile in form-fit therein.

This method provides an acoustic baffle with a recess having the advantages already discussed above in connection to the acoustic baffle. Moreover the method provides a convenient way to apply the design to the acoustic baffle.

Preferably, the method for producing an acoustic baffle further comprises the steps of cutting separate V-shaped cut out sections between a first panel portion and a third panel portion and between a second panel portion and the third panel portion, respectively; and folding the first panel portion towards the second panel portion so that one side surface of the first panel portion contacts one side surface of the second panel portion.

This aspect allows for providing the design (illustration or a décor) continuously and seamlessly from one side of a panel to the other while conveniently forming the acoustic baffle by folding individual panel portions.

Preferably, the method further comprises the step of cutting a first slit into the first panel portion and a second slit into the second panel portion so as to form a recess capable of accommodating a suspension profile therein when folded. This allows producing a baffle having a recess capable of accommodating a T-shaped suspension profile. Particularly preferred, the method further comprises the step of arranging the suspension profile in the recess.

According to another aspect, the acoustic baffle is pushed on the suspension profile such that the suspension profile slides along the recess until its final position is reached.

Such a baffle can be mounted virtually without any specialized tools, i.e. only tools are necessary that are usually available at a construction site. Individual baffles can be connected to each other, for example along their short edges and thus form a continuous band along the ceiling. The connection can be achieved by various means, for example by using dowels, clamps, crimps or similar.

Figure 2:
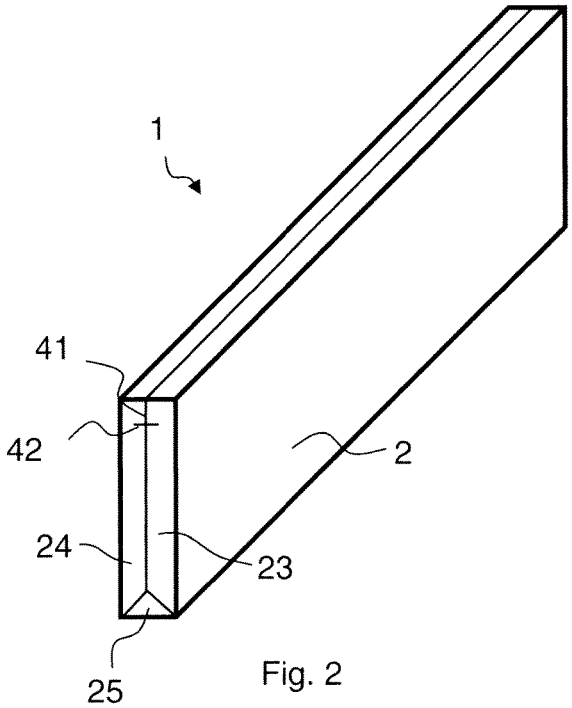
Figure 3:
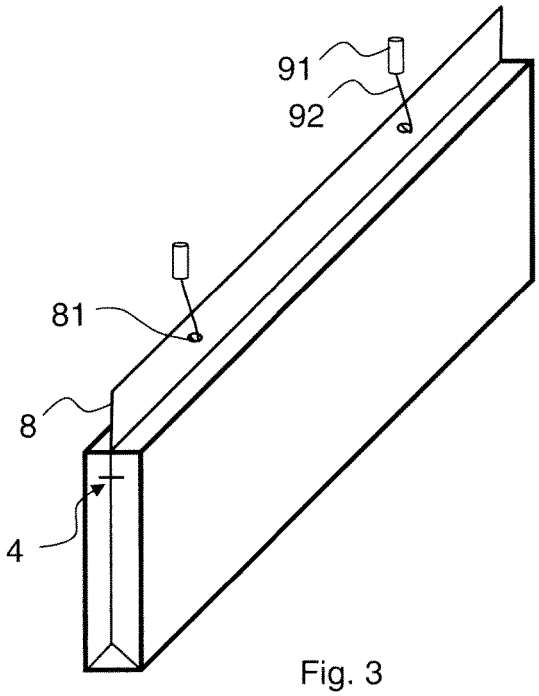
Figure 4:
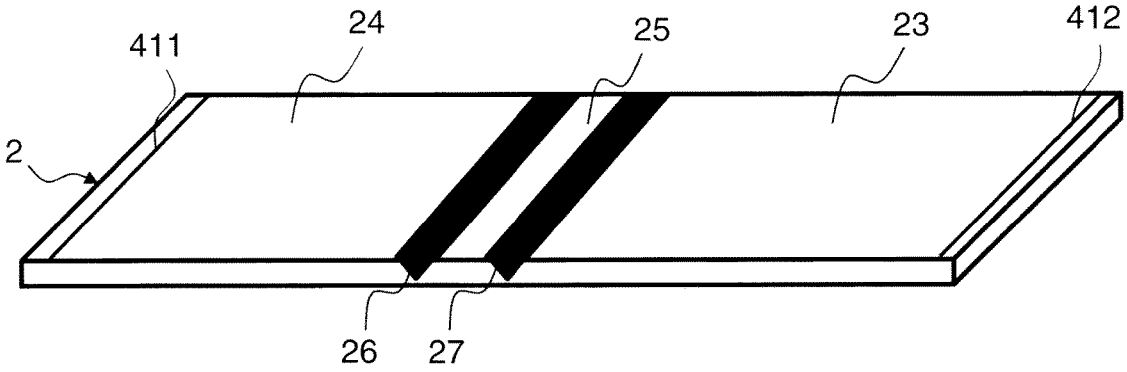

In the following the invention will be explained in more detail with reference to drawings. Like reference numerals denote similar features throughout the drawings. The drawings show:

FIG. 1: Perspective view on an acoustic baffle according to the invention;

FIG. 2: Perspective view on the acoustic baffle of FIG. 1 which is formed by folding respective panel sections;

FIG. 3: Perspective view on the acoustic baffle of FIG. 2 having means for suspension arranged thereon;

FIG. 4: Perspective of a sound absorbing panel to be folded for producing an acoustic baffle according to the invention; and FIG. 5: Room of a building having arranged a plurality of acoustic baffles at the ceiling.

FIG. 1 illustrates a frameless acoustic baffle 1 to be arranged at the ceiling in a room (see FIG. 5, Ref. 10) of a building. The acoustic baffle 1 comprises a panel 2 of a porous sound absorbing material (e.g. mineral wool). The baffle 1 further comprises at its upper side an edge portion 3 arranged at the panel 2. The edge portion 3 has a recess 4 arranged therein which is formed in panel 2 extending continuously between a first (front) side surface 21 and a second (back) side surface 22.

The recess 4 is arranged in the middle of edge portion 3 (upper outer surface) and extends into (the inside of) the baffle 1 (i.e. into the panel 2) with a first section 41 extending rectangular to the upper outer surface of the edge portion 3. A second section 42 is joined to the first section 41 and extends parallel to the upper outer surface of the edge portion 3 so as to form a T-shaped recess 4 having a size to be capable of accommodating a T-shaped suspension profile (shown in FIG. 3, Ref. 8) therein. The recess 4 allows for fixing the suspension profile in a mechanically strong connection and allows for a quick installation of acoustic baffle 1 to the ceiling in the room, e.g. by use of a suspension wire.

A foldable acoustic baffle 1 is shown in FIG. 2, wherein the baffle 1 comprises a first panel portion 23, a second panel portion 24 and a third panel portion 25. Two separate V-shaped cut out sections (see FIG. 4) are parallel formed between the first panel portion 23 and the third panel portion 25 and between the second panel portion 24 and the third panel portion 25. In the folded state of the panel 2, the surfaces of the V-shaped cut out sections are in contact to each other (e.g. are glued to each other). The first panel portion 23 and the second panel portions 24 are folded parts of one single panel of sound absorbing material. The recess 4 is arranged at the interface between the first panel portion 23 and the second panel portion 24 so as to extend preferably over the entire width of both panel portions. A second section 42 is joined to the first section 41 in a manner so as to form a T-shaped recess 4 having a size to be capable of accommodating a T-shaped suspension profile. The second section is formed by arranging a slit in the respective panel portions as it will be explained in context of FIG. 4.

The installation of such an acoustic baffle is illustrated in FIG. 3, wherein a suspension profile 8 is arranged in the recess 4. The suspension profile 8 is slid or pushed along the recess 4 until its final position is reached. The suspension profile 8 comprises two openings 81 in which the hook shaped suspension wires 92 are arranged. The opposite ends of the suspension wires are connected to the ceiling (adjustable in length/height) via hanger connectors 91.

A panel 2 to be folded to form an acoustic baffle according to the invention is shown in FIG. 4. The preparation of the panel includes the formation of two V-shaped cut out sections 26, 27. The distance between these cut out sections is chosen to allow for a plan contact of the first panel portion 23 and the second panel portion 24 (when folded). The distance defines the size of the third panel portion 25.

The method for producing an acoustic baffle includes providing a panel 2 of a sound absorbing material. Optionally an illustration or a décor (design) is applied on at least one of the main surfaces of the panel 2. Advantageously, the design is applied continuously and seamlessly over one entire surface (outer surface of first, second and third panel portion 23, 24, 24) of the unfolded panel. Two slits 411, 412 are provided (on the opposite side thereto) to form the second section (see FIG. 2; Ref. 42) of the recess of the folded panel.

The first panel portion 23 is folded towards the second panel portion 24 so that one side surface of the first panel portion 23 flatly contacts one side surface of the second panel portion 24 and so that the recess for accommodating the suspension profile is formed. Thereafter the acoustic baffle 1 is pushed on the suspension profile such that the suspension profile slides along the recess until its final position is reached.

Figure 5:
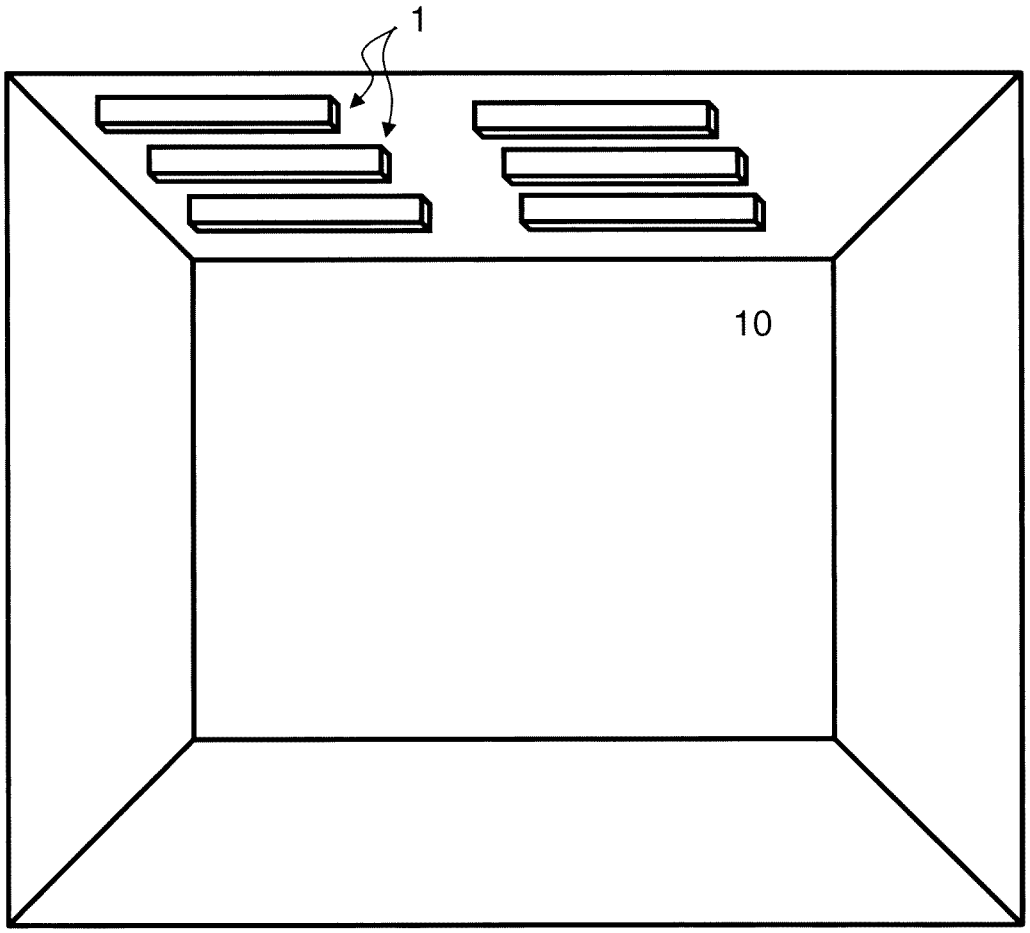

A plurality of acoustic baffles 1 can be arranged in a room 10 as shown in FIG. 5, wherein the acoustic baffles 1 can be arranged along a line so as to make a uniformly arranged visual impression to a viewer.

The invention claimed is:

1. Acoustic baffle to be arranged in a building for the absorption of sound propagating there through, the acoustic baffle comprising at least one panel of a sound absorbing material, wherein the acoustic baffle comprises at least one edge portion having a recess arranged therein so as to include and being formed in a first side surface and a second side surface and being of a size and shape so as to be capable of accommodating a suspension profile in form-fit therein, wherein the acoustic baffle is frameless, and wherein the recess extends continuously along the at least one edge portion between the first side surface and the second side surface so that the suspension profile is insertable via the first side surface or the second side surface and is slidable along the recess.

2. Acoustic baffle according to claim 1, wherein the recess has a first section extending perpendicularly to a surface of the at least one edge portion and a second section joined to the first section extending parallel to the surface of the at least one edge portion so as to form a recess capable of accommodating a T-shaped suspension profile therein.

3. Acoustic baffle according to claim 1, wherein the acoustic baffle comprises a first panel portion and a second panel portion which are connected to each other so that one side surface of the first panel portion contacts one side surface of the second panel portion forming the recess at an interface between the first panel portion and the second panel portion.

4. Acoustic baffle according to claim 3, wherein the first panel portion and the second panel portion are folded parts of one single panel.

5. Acoustic baffle according to claim 3, wherein the first panel portion comprises a first slit and the second panel portion comprises a second slit, the first slit and the second slit being aligned so as to form a second section of the recess.

6. Acoustic baffle according to claim 3, wherein the at least one panel comprises a third panel portion arranged between the first panel portion and the second panel portion, and wherein separate V-shaped cut out sections are formed between the first panel portion and the third panel portion and between the second panel portion and the third panel portion, respectively.

7. Acoustic baffle according to claim 1, wherein the acoustic baffle has an overall illustration or decor, continuously and seamlessly extending at least from a front side over a bottom side to a back side of the acoustic baffle.

8. Acoustic baffle according to claim 1 further comprising the suspension profile arranged in the recess.

9. Method for producing an acoustic baffle comprising the steps of:

providing a panel of a sound absorbing material;

applying an illustration or a decor on at least one main surface of the panel;

providing at least one slit in another surface of the panel to form a recess capable of accommodating a suspension profile in form-fit therein;

cutting separate V-shaped cut out sections between a first panel portion and a third panel portion and between a second panel portion and the third panel portion, respectively;

folding the first panel portion towards the second panel portion so that one side surface of the first panel portion contacts one side surface of the second panel portion;

cutting a first slit into the first panel portion and a second slit into the second panel portion so as to form a recess capable of accommodating a suspension profile therein when folded; and arranging the suspension profile in the recess;

wherein the acoustic baffle is pushed on the suspension profile such that the suspension profile slides along the recess until its final position is reached.

* * * * *